United States Patent [19]

Kusunoki et al.

[11] 4,211,910

[45] Jul. 8, 1980

[54] HIGH FREQUENCY HEATING APPARATUS WITH IMPROVED DOOR ARRANGEMENT

[75] Inventors: Shigeru Kusunoki, Yamatokoriyama; Junzo Tanaka, Fujiidera, both of Japan

[73] Assignee: Matsushita Electric Industrial Co., Ltd., Kadoma, Japan

[21] Appl. No.: 958,448

[22] Filed: Nov. 7, 1978

[30] Foreign Application Priority Data

Dec. 21, 1977 [JP] Japan ..... 52/155210

[51] Int. Cl.[2] ..... H05B 9/06

[52] U.S. Cl. ..... 219/10.55 D; 219/10.55 R; 174/35 MS

[58] Field of Search ..... 219/10.55 D, 10.55 C, 219/10.55 R; 174/35 MS, 35 R

[56] References Cited

U.S. PATENT DOCUMENTS

| | | | |
|---|---|---|---|
| 3,436,508 | 4/1969 | Fritz | 219/10.55 D |
| 3,511,959 | 5/1970 | White | 219/10.55 D |
| 3,629,537 | 12/1971 | Haagensen | 219/10.55 D |
| 3,678,238 | 7/1972 | Yasuoka et al. | 219/10.55 D |
| 3,711,673 | 1/1973 | Takeda et al. | 219/10.55 D |
| 3,866,009 | 2/1975 | Ishino et al. | 219/10.55 D |
| 4,010,343 | 3/1977 | Tanaka et al. | 219/10.55 D |
| 4,028,519 | 6/1977 | De Weese et al. | 219/10.55 B |

FOREIGN PATENT DOCUMENTS

| | | | |
|---|---|---|---|
| 52-112842 | 9/1977 | Japan | 219/10.55 E |

*Primary Examiner*—B. A. Reynolds
*Assistant Examiner*—Philip H. Leung
*Attorney, Agent, or Firm*—Wenderoth, Lind & Ponack

[57] ABSTRACT

A high requency heating apparatus including a door assembly having a high frequency energy shielding member and a plurality of glass plate members disposed in front and on the outer side of the shielding member. The distances between the shielding member and plurality of glass plate members are such that a composite-impedance $Z_T$ made up of the impedance of the shielding member, the impedance of the glass plate members and the impedance of the space around the heating apparatus becomes approximately equal to or smaller than the composite impedance $Z_s$ made up of the impedance of the shielding member and the impedance of the external space in the absence of the glass plate member for reducing microwave leakage at the front portion of the door assembly.

9 Claims, 17 Drawing Figures

Fig. 12 (a-1)
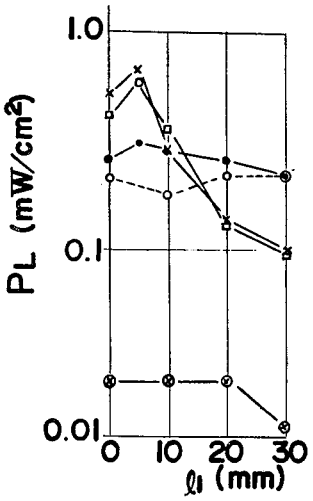
Fig. 12 (b-1)
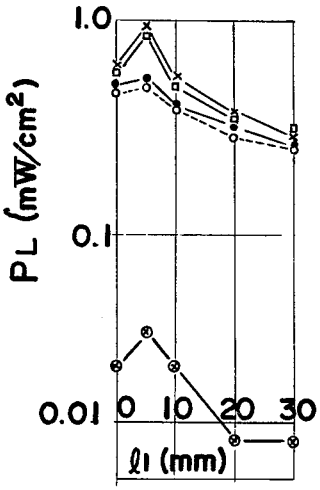
(at IMHZ)
□ — εr = HEAT CRYSTALLIZING GLASS
× — εr = REINFORCED GLASS
• — εr = POLYPROPYLENE
○ — εr = AIR
⊗ — ZnO Coated glass (Both Sides)
Fig. 12 (a-2)
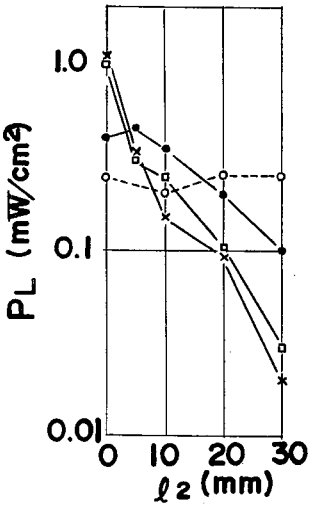
Fig. 12 (b-2)
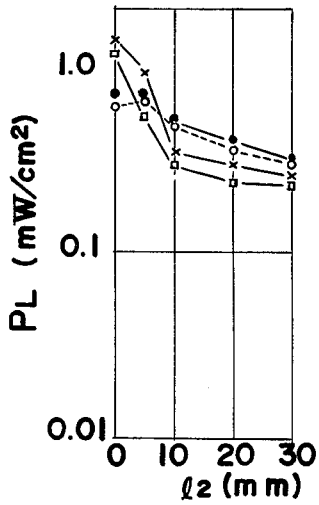
Fig. 12 (a-3)
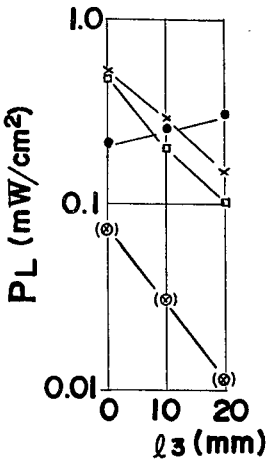
Fig. 12 (b-3)
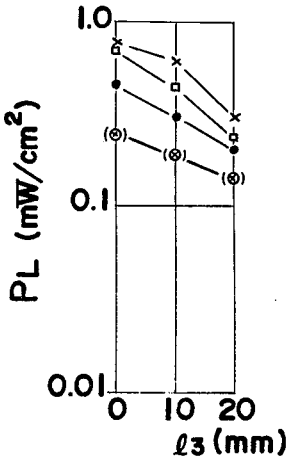

HIGH FREQUENCY HEATING APPARATUS WITH IMPROVED DOOR ARRANGEMENT

BACKGROUND OF THE INVENTION

The present invention relates to a high frequency heating apparatus, and more particularly to a high frequency heating apparatus equipped with an improved door arrangement in which leakage of high frequency energy from a high frequency shielding member of an observation window provided in the door is reduced.

Generally, in a high frequency heating apparatus, for example, in a microwave oven particularly having an electric heating capability in addition to the high frequency or dielectric heating capability and known as a microwavethermal oven, it is required to provide a glass plate member in front and at the outer side of the high frequency shielding member for reducing heat radiation from the heating chamber or heating cavity through the shielding member and maintaining the surface of the door at low temperatures. Especially, when soiling in the heating chamber of the microwave oven is to be removed by thermal decomposition to clean the oven, the temperature within the heating chamber rises close to approximately 500° C., and thus, a plurality of glass plates are required to be installed for maintaining the outermost surface thereof at low temperatures.

For mounting the glass plates as described above in the door assembly, however, special arrangements become necessary particularly to prevent leakage of the microwave energy with respect to the shielding member. Although the microwave leakage through the shielding member which has substantially no movable parts does not increase, for example, due to variations with time, etc. as compared with the microwave leakage from gaps and the like between the heating chamber and the door, such microwave leakage, if large in amount, tends to cause the leakage value to exceed standard values because of a large local power density concentration by generation of standing waves resulting from relative interference thereof with respect to microwave leakage sources around the door.

In connection with the above, existing standards set by the government require that the leakage of microwave energy from microwave cooking appliances should be kept to minimum levels.

Accordingly, in the arrangements of microwave ovens on the whole, it is extremely important to suppress the microwave energy leakage from the shielded portion in the front of the door.

In view of the peculiar problems as described in the foregoing, there have heretofore been proposed microwave ovens, for example, in U.S. Pat. No. 4,028,519 patented on June 7, 1977 and in Japanese Laid Open Patent Application Tokkaisho No. 52-112842, each provided with a particular arrangement for preventing microwave energy leakage. The known arrangements as described above, however, still have a tendency to permit increased microwave energy leakage from the front portion of the door for the heating chamber, thus presenting problems to be further solved with respect to the microwave energy leakage.

SUMMARY OF THE INVENTION

Accordingly, an essential object of the present invention is to provide a high frequency heating apparatus, for example a microwave-thermal oven type, which is equipped with an improved door arrangement having a glass plate member provided in front of and on the outer side of a shielding member for reducing leakage of microwave energy at the surface of said glass plate member.

Another important object of the present invention is to provide a high frequency heating apparatus of the above described type in which the glass plate member provided in front of and on the outer side of the shielding member is light transmitting for making it possible to observe the state of an object being heated in a heating chamber through said glass plate member from the outside of the oven after closing of said door.

A further object of the present invention is to provide a high frequency heating apparatus of the above described type in which the glass plate member is constituted by a plurality of glass plates disposed in front of and on the outer side of the shielding member in spaced and parallel relation to said shielding member to minimize the temperature rise at the surface of the outermost glass plate for safety of a user especially during electrical heating.

A still further object of the present invention is to provide a high frequency heating apparatus of the above described type in which the glass plates are spaced at predetermined distances from each other and from the shielding member to reduce heat dissipation from the door portion for improving heat distribution within the heating chamber during the electrical heating.

Another object of the present invention is to provide a high frequency heating apparatus of the above described type which has a simple construction and functions accurately, and can be produced on a large scale at low cost.

In accomplishing these and other objects according to the present invention, the high frequency heating apparatus includes an oven defining structure, a heating cavity defined by wall members within the oven defining structure, a door assembly of the drawer type adapted to selectively open and close an access opening defined at one side of said heating cavity, means for supplying microwave energy into the heating cavity for dielectric heating of an object to be heated which has been placed therein, and an electric heating arrangement provided in said heating cavity for electrically heating the object to be heated in said heating cavity. The door assembly further includes a door shielding member and a plurality of glass plate members disposed in front of and on the outer side of the door shielding member remote from said heating cavity, the shielding member and plurality of glass plate members having distances therebetween such that the composite impedance $Z_T$ made up of the impedance of the shielding member, the impedance of the glass plate members and the impedance of the space external to the oven is approximately equal to or smaller than the composite impedance $Z_S$ made up of the impedance of the shielding member and the impedance of the external space in the absence of the glass plate member.

By the arrangement as described above, not only is the microwave energy leakage from the front portion of the door assembly during the dielectric heating effectively reduced, but the temperature raise at such front portion particularly during electrical heating is advantageously reduced.

BRIEF DESCRIPTION OF THE DRAWINGS

These and other objects and features of the present invention will become apparent from the following description taken in conjunction with the preferred embodiment thereof with reference to the accompanying drawings, in which;

FIGS. 12(*a*-1) to 12(*b*-3) are graphs showing the results of the experiments described with reference to FIGS. 8 to 11.

Before the description of the present invention proceeds, it is to be noted that like parts are designated by like reference numerals throughout the several views of the attached drawings.

DETAILED DESCRIPTION OF THE INVENTION

Figure 1:
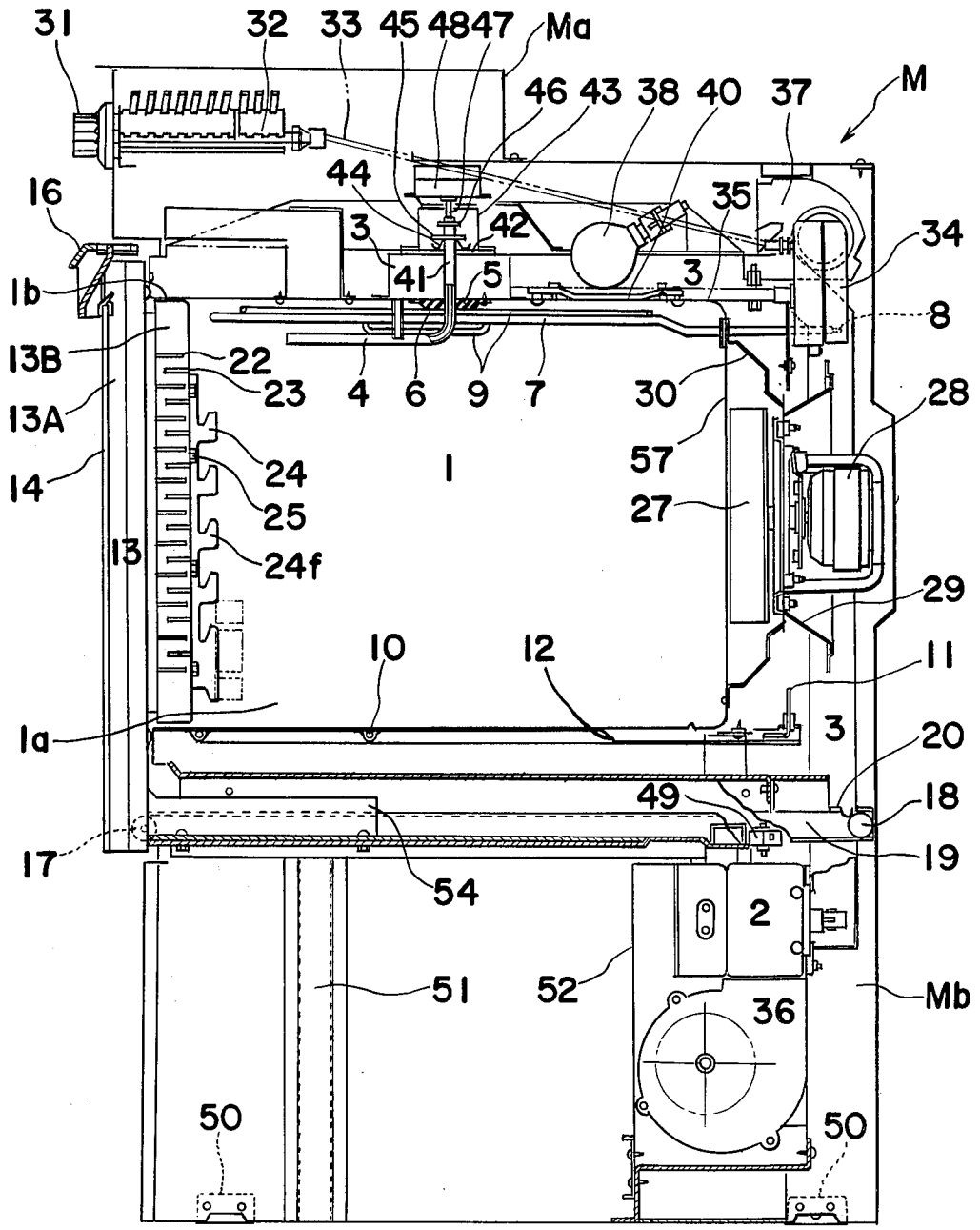
FIG. 1 is a side sectional view of a high frequency heating apparatus having a drawer type door assembly in which an improved door arrangement directly related to the present invention is incorporated.

Referring now to the drawings, there is shown in FIG. 1 a high frequency heating apparatus or microwave oven having a drawer type door assembly which is provided with an improved door arrangement directly related to the present invention.

The high frequency heating apparatus M generally includes a microwave energy source, for example, a magnetron 2, capable of emitting microwaves when energized and disposed at a lower portion Mb of a housing structure or oven defining structure Ma. The microwaves from the magnetron 2 are guided through a waveguide 3 towards an antenna 4, while a portion of said antenna 4 protrudes into a heating chamber or heating cavity 1 defined by wall members 1a within the oven defining structure Ma through an opening 5 provided in the waveguide 3 so that the microwaves supplied to the antenna 4 can be radiated into the heating chamber 1. The opening 5 defined in the waveguide 3 and through which the antenna 4 protrudes into the heating chamber 1 is closed by a cover 6 made of dielectric material.

For the purpose of providing an electric heating capability in addition to the microwave or dielectric heating capability, the microwave oven M shown further includes an electric heater 7 extending into the heating chamber adjacent the top of said heating chamber 1 and coupled to an electric power supply socket 8, said electric heater 7 being supported in position by holders 9. In addition to the heater 7, an additional heater 10 is provided and positioned externally of the heating chamber 1 and beneath the bottom of the heating chamber 1, said additional heater 10 being coupled to an electric power supply socket 11 and covered by a heater cover 12.

Figure 3:
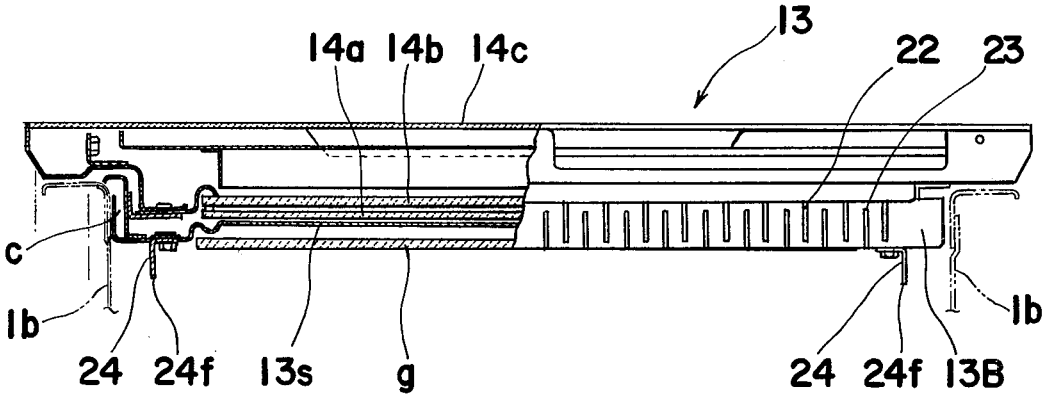
FIG. 3 is a top plan view, partly broken away and in section, of an upper portion of the door of FIG. 2.
Figure 4:
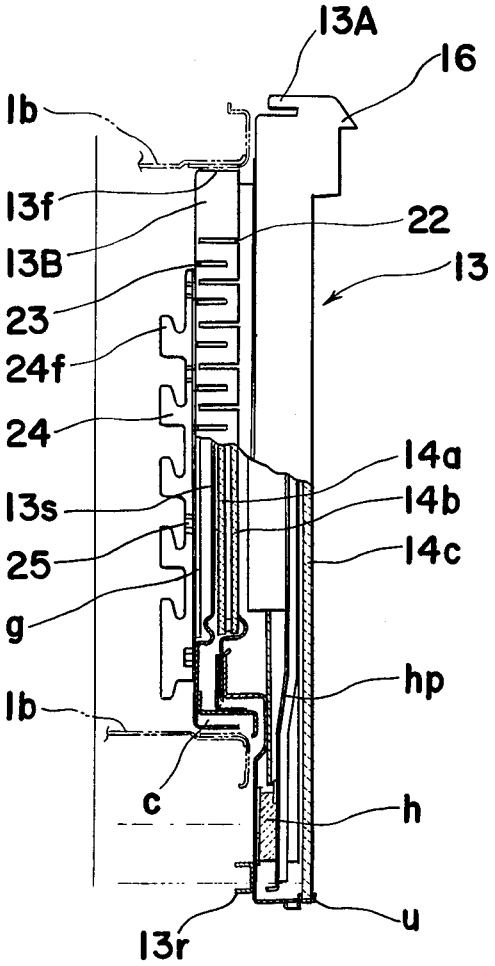
FIG. 4 is a side elevational view, partly broken away and in section, of the door of FIG. 2.

The drawer type door assembly comprises a door structure 13 including a glass plate member 14 and a high frequency energy shielding member or perforated plate 13*s* (FIGS. 3 and 4) described in detail later, and a handle 16 accessible to the hand of a user of the microwave oven, and a door rail structure 19 extending substantially at right angles to the door structure 13 and carrying a plurality of rollers 18, said door assembly being supported for movement between closed and opened positions by said rollers 18 and a plurality of rollers 17 which are rotatably supported on the lower portion Mb of the microwave oven housing structure Ma. The door rail sturcture 19 is rigidly connected at one end thereof to the bottom of the door structure 13 by means of a bracket 54, the other end of said rail structure 19 being provided with a spring stop 20 which is made of an elastic metallic material and which holds the door assembly in the closed position when the latter is moved to the closed position.

The door structure 13 further includes a front door portion or a door 13A and a rear door portion or a door 13B, and the door 13B has a flange 13f bent at right angles relative to the body of the door 13B and extending towards the door 13A, which flange 13f has a plurality of slits 22 therein and a plurality of reinforcing ribs 23 therein and defines a choke cavity C (FIG. 4) in cooperation with the door 13A, and is fitted into the front wall 1*b* of the heating chamber 1 when the door structure 13 is moved into the closed position. At least one pair of hook members 24 each having a plurality of hooks 24*f* are secured to the door 13B by means of hexagonal bolts 25.

The microwave oven further comprises a circulator fan 27 adapted to be driven by a motor 28 housed within a casing 29, said fan 27 being separated from the heating chamber 1 by a perforated partition wall 57. It is to be noted that, since the partition wall 57 is perforated, an air current produced by the fan 27 being rotated by the motor 28 can flow into the heating chamber 1 through perforations in the partition wall 57. The circulator fan 27 is positioned behind the perforated partition wall 57 and housed within a chamber defined by said partition wall 57 and a covering 30 surrounding the perimeter of the circulator fan 27.

Positioned above the door structure 13 is a control panel having a manipulatable temperature control knob 31 operatively coupled to a control box 32 which is in turn coupled through a connecting rod 33 to a temperature control switch 34 operatively associated with a temperature sensor 35.

Positioned adjacent the magnetron 2 is a cooling fan 36 for cooling the magnetron 2 during the energization of the latter. There is also employed a ventilator fan 37 positioned externally of and adjacent an upper rear corner of the heating chamber 1.

For illuminating the heating chamber 1, an electric lamp 38 is employed, the light emitted from the lamp 38 being transmitted towards the heating chamber 1 through an illuminating window 40 which is defined in the top wall of an oven-defining structure and which is covered by a glass plate 40 for preventing spatters from reaching the lamp 38.

The antenna 4 is coupled to a drive shaft 47 of a motor 48 through a connecting shaft 41 made of dielectric material, said connecting shaft 41 rotatably extending through a dielectric plate member 42 which also serves as a bearing plate. The motor shaft 47 and the connecting shaft 41 extend through a space defined by a covering 43 and, within such space defined by the covering 43, there is provided a sliding cone 44 mounted in part on the motor shaft 47 and in part on the connecting shaft 41 and secured thereto by means of respective pins 46 and 45.

A microswitch 49 disposed above the magnetron 2 in FIG. 1 is adapted to be closed only when the door assembly is held in the closed position. The lower portion Mb of the housing structure Ma is reinforced by body reinforcement beams 50 and body reinforcement ribs 51. The magnetron 2 and the cooling fan 36 are housed within a casing 52 positioned in the lower portion Mb below the oven-defining structure Ma having the heating chamber 1 defined therein.

Figure 2:
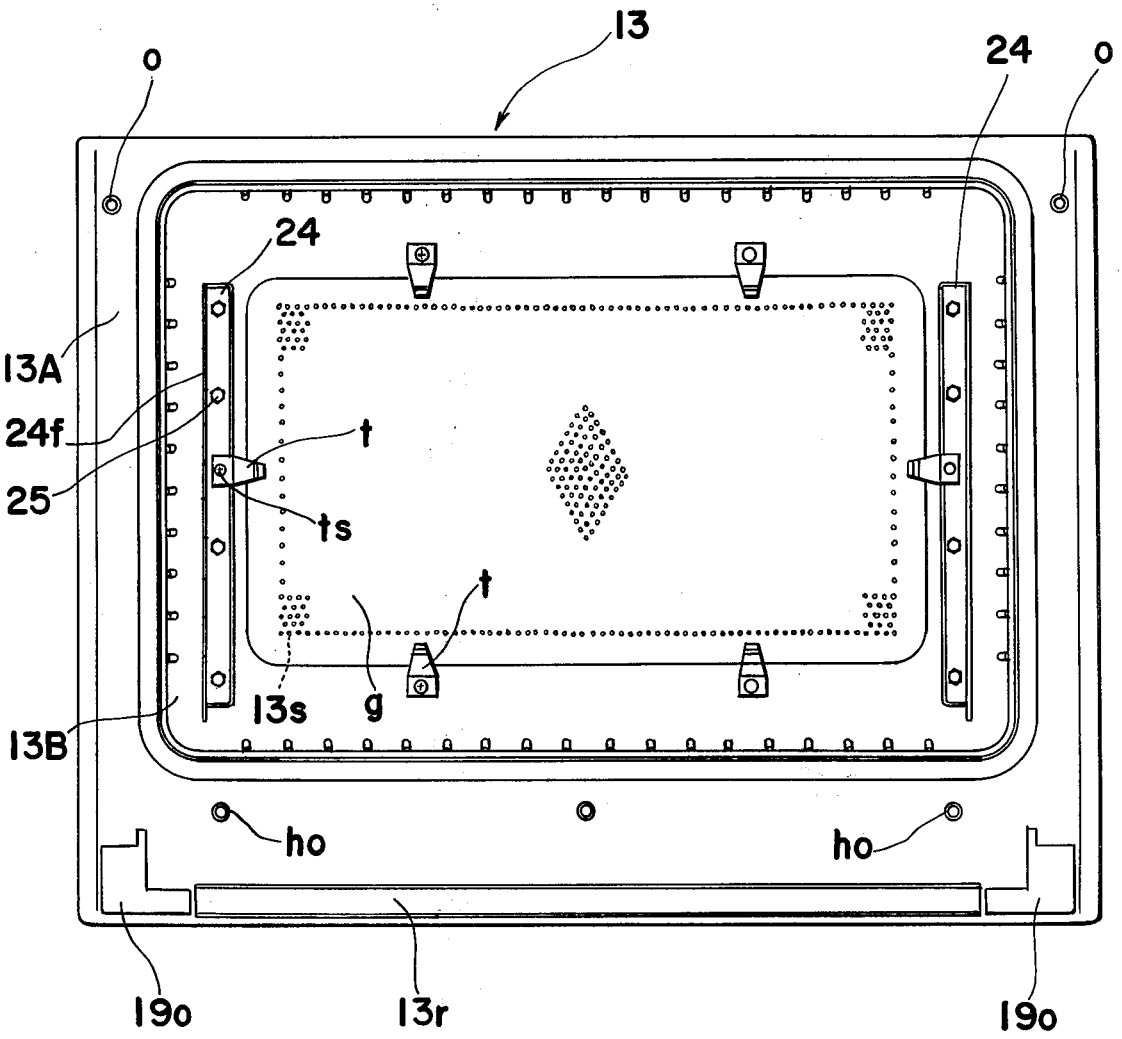
FIG. 2 is a rear view, on an enlarged scale, of a door employed in the high frequency heating apparatus of FIG. 1 and observed from within the heating chamber of said high frequency heating apparatus.

Referring also to FIGS. 2 through 5, the door structure 13 includes the glass plate member 14, i.e., three glass plates **14*a*, 14*b* and 14*c* in this embodiment provided in front of and on the outer side of the high frequency shielding member or perforated plate 13*s* in that order and supported in spaced and parallel relation to said perforated plate 13*s*, with the glass plates 14*a* and 14*b* and the perforated plate 13*s* being supported by the door 13B, while the outermost glass plate 14*c* is supported by holders U secured to said door 13A through heat insulating material h which is suitably fixed to the door 13A at openings ho (FIG. 2) formed in the door 13A and held by a suitable pressing member hp provided between the glass plate 14c and the heat insulating member h. On the inner side with respect to the perforated plate 13s, i.e., at the side thereof exposed to the heating chamber 1, a glass plate g having a low high frequency loss, for example of borosilicate glass, is held in spaced relation to the perforated plate 13*s* by holders t fixed to the door 13B, for example, by set screws ts, through gaskets 13*p* extending around the perforated plate 13*s* as is most clearly seen in FIG. 5. As shown in FIG. 2, the door 13A is further provided with openings O for securing the handle 16, openings 19*o* for securing the door rail structure 19 and a reinforcing member 13*r* secured to the door 13A between the openings 19*o***.

Figure 5:
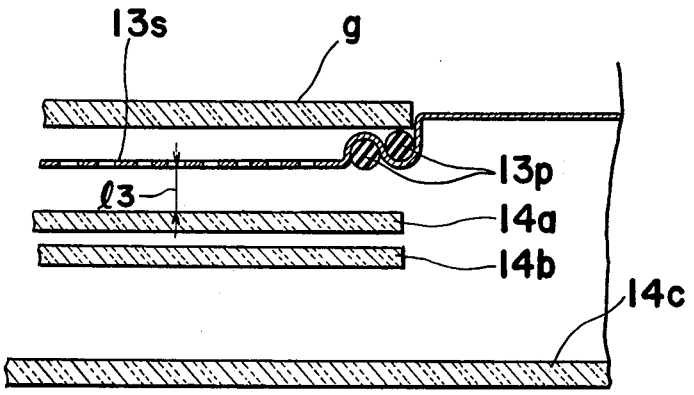
FIG. 5 is a fragmentary sectional view showing, on a still further enlarged scale, the construction of the door according to one preferred embodiment of the present invention having three glass plates disposed in front of and on the outer side of the shielding member, and employed in the arrangement of FIG. 2, FIGS. 6 and 7 are views similar to FIG. 5, but particularly showing modifications thereof in which two glass plates are disposed in front of and on the outer side of the shielding member.

In the door arrangement of FIG. 5 according to one preferred embodiment of the present invention, soda-lime glass which has been subjected to heat or chemical reinforcing treatment is employed for the glass plates **14*a*, 14*b* and 14*c*. It is to be noted here that employment of glass having an electrically conductive and light transmitting thin film layer of tin oxide or the like formed on one surface or both surfaces of at least one of the glass plates 14*a* to 14*c* is effective for further reduction of the microwave leakage as described more in detail later. In the arrangement of FIG. 5, the distance between the glass plates 14*a* and 14*b* is set to be less than 7 mm, and that between the glass plates 14*b* and 14*c* to be more than 5 mm, while the distance $l_3$ between the perforated plate 13*s* and the glass plate 14*a*** is set to be more than 10 mm.

Figure 6:
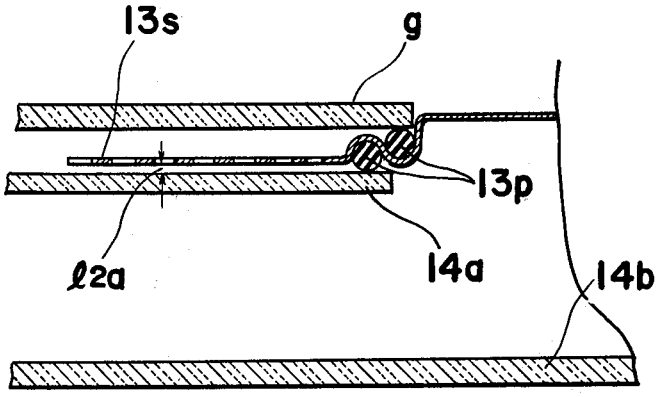
Figure 7:
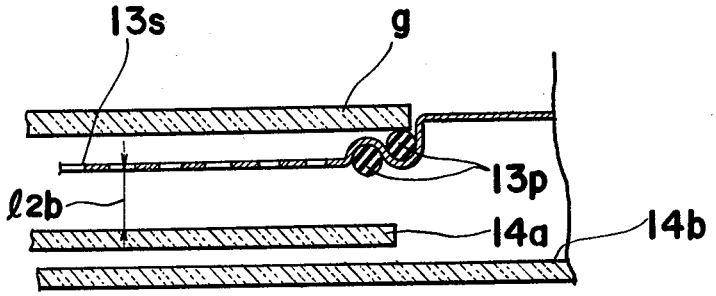

Referring to FIGS. 6 and 7, there are shown modifications of the arrangement of FIG. 5. In these modifications, the outermost glass plate **14*c* described as employed in the embodiment of FIG. 5 is dispensed with, and in FIG. 6, the glass plate 14*a* is spaced from the glass plate 14*b* by more than 10 mm, with the distance $l_{2a}$ between the perforated plate 13*s* and the glass plate 14*a* being set to be within 5 mm. In the arrangement of FIG. 7, the glass plate 14*a* is spaced from the glass plate 14*b* by less than 5 mm, with the distance $l_{2b}$ between the perforated plate 13*s* and the glass plate 14*a*** being set to be more than 10 mm.

The effectiveness and necessity of the dimensional limitations in the foregoing embodiments for the door arrangement according to the present invention have been derived by the present inventors through an investigation into the matter and experiments carried out in connection therewith as described hereinbelow with reference to FIGS. 8 through 11.

In FIGS. 8 to 11 there are schematically shown arrangements for the experiments mainly carried out on a high frequency heating apparatus having a frequency centered at 2,450 MHz at a power consumption of 600 W, with 275 cc of water being placed therein as a load. A plate Ip was provided which was equivalent to the perforated plate **13*s*, dielectric members or heat reinforced glass plates Gp1, Gp2 and Gp3 were provided which were respectively equivalent to the glass plates 14*a*, 14*b* and 14*c* in the embodiments of FIGS. 5 to 7**, while the symbol V designates a probe which was used for microwave leakage measurements.

Figure 8:
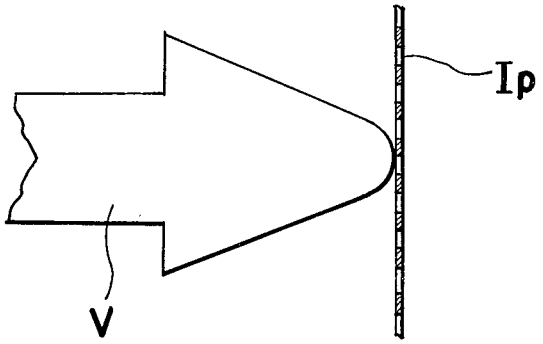
FIGS. 8 to 11 are schematic diagrams for explaining experiments carried out for deriving the door arrangements in FIGS. 5 to 7.
Figure 9:
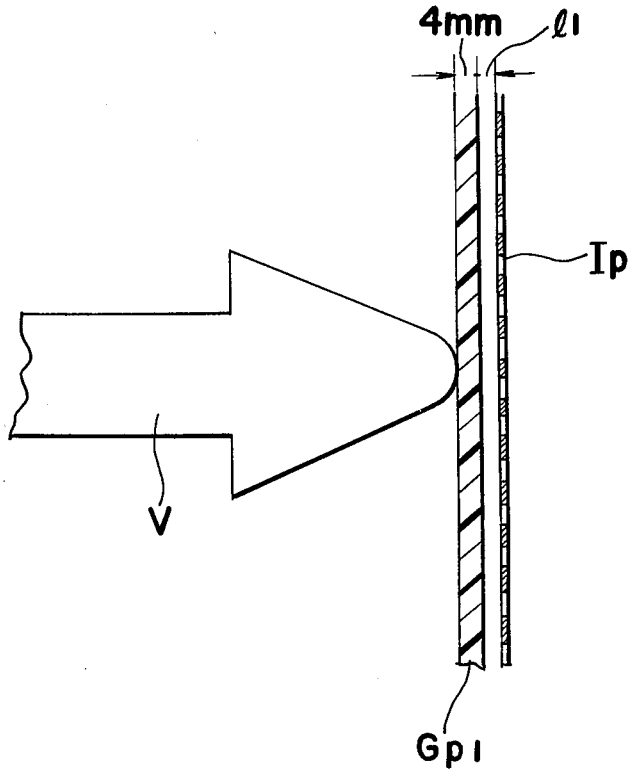

The concept of the present invention originated from the findings that, when the distance $l_1$ is set to be approximately 5 mm in the arrangement of FIG. 9 employing one glass plate Gp1, the amount of the microwave leakage is increased as compared with that in the arrangement of FIG. 8 in which the tip of the probe V was disposed close to the perforated plate Ip without an intervening glass plate Gp1.

More specifically, upon comparison of the arrangements of FIGS. 8 and 9, despite the fact that the distance between the perforated plate Ip and the tip of the probe V in FIG. 9 was approximately 10 mm (thickness of glass plate $Gp1=4$ mm+distance $l_1=5$ mm) and much larger than the distance therebetween (at most 1 mm) in the arrangement of FIG. 8, microwave leakage in an amount approximately two times as large as that in FIG. 8 was measured in the arrangement of FIG. 9. Such results can not be explained by the general concept that the electrical density is decreased as the tip of the probe is moved further from an oscillating source (not shown).

Accordingly, in the experiments described hereinbelow, the present inventors considered that the phenomenon as described above could be explained by taking into account three impedances, i.e., the impedance of the heating chamber in terms of microwaves, the impedance including the glass plate member, and also the impedance of the space external to the oven. Of these impedances, the impedance for the heating chamber and that of the external space can be considered to be constant in the experiments. Therefore, in the arrangements of FIGS. 8 and 9, the present inventors assumed that only the impedance at the door shielding portion (including the glass plate in FIG. 9) was varied by to the presence or absence of the dielectric or glass plate, and the distance between the perforated plate and the glass plate.

Figure 10:
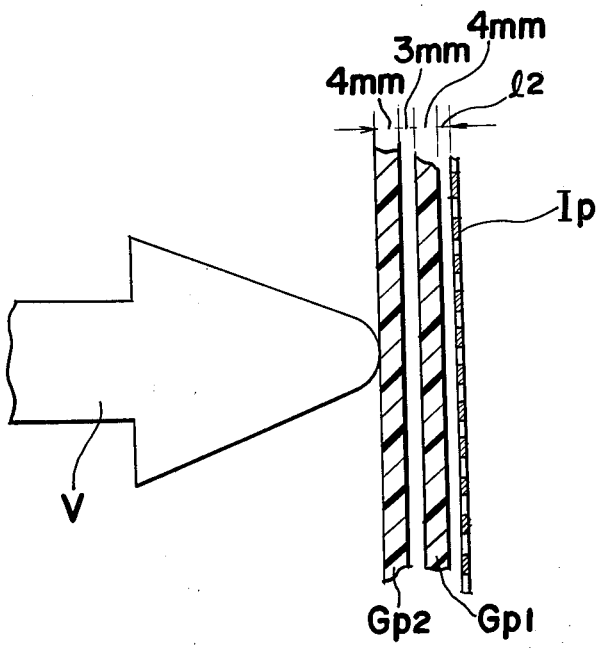
Figure 11:
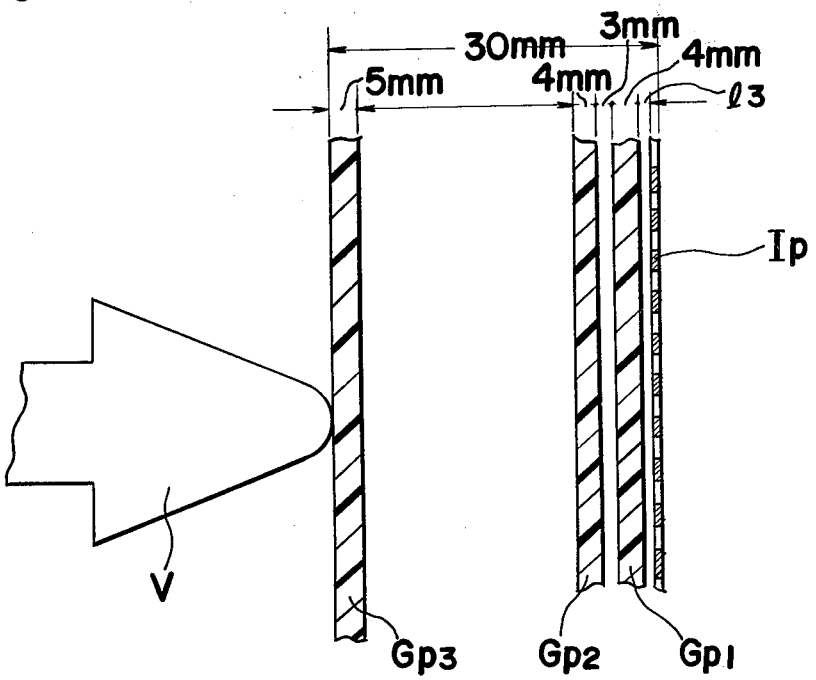

More specifically, if the impedance of the heating chamber (i.e. microwave resonator) is represented by $Z_O$, that of the perforated plate by $Z_P$, that of the external air space by $Z_A$, and that of the glass plate by $Z_G$, the composite impedance of $Z_P$ and $Z_A$ can be defined as $Z_S$, and in the case of FIGS. 9 to 11, the composite impedance of $Z_P$ and a plurality of impedances $Z_A$ and $Z_G$ can be defined as $Z_T$.

The above definition of the impedances can be associated with the microwave energy leakage by considering the matching of the impedance $Z_O$ of the heating chamber, and composite impedances $Z_S$ and $Z_T$ as described above. In other words, when the value of the impedance $Z_O$ is close to the values of the composite impedances $Z_S$ and $Z_T$, favorable matching is achieved, and the electric power of the heating chamber will leak toward the outside through the perforated plate. On the contrary, if the value of the impedance $Z_S$ is substantially different from the values of the composite impedances $Z_S$ and $Z_T$, matching is not perfectly achieved, and a large reflection takes place at the perforated plate to prevent the microwave leakage. Upon review of the earlier described results of the experiments from the viewpoint as described above, in the arrangement of FIG. 8, the degree of mismatching in the composite impedances $Z_S$ and $Z_O$ is large when the external space (intrinsic impedance $Z_A \approx 120\pi(\Omega)$) is looked into through the perforated plate at the shielding portion. In comparison with the above, in the case of FIGS. 9 to 11, the degree of mismatching of the composite impedance $Z_T$ of the impedance $Z_P$ for the shielding portion, impedance $Z_A$ for the external space and impedance $Z_G$ (intrinsic impedance $Z_G \approx 120\pi/\sqrt{\epsilon_r}$) for the glass plate (specific inductive capacity $\epsilon_r \approx 4.5 \sim 7$) with respect to the impedance $Z_O$ of the heating chamber may be considered to be small. The value of the composite impedance $Z_T$ can naturally be varying the thickness of and the number of the glass plates or spacing therebetween.

Therefore, in the designing of the high frequency heating apparatus, the leakage of the microwave energy may be reduced even when a glass plate is provided by making the value of the composite impedance $Z_T$ approximately equal to that of the composite impedance $Z_S$. Conversely, by making the level of the microwave leakage when a glass plate is provided equal to the case where no glass plate member is provided, it can be deduced that the composite impedance $Z_S$ has become equal to the composite impedance $Z_T$.

Subsequently, for making it possible to deal with the concept as described in the foregoing as quantitatively as possible, experiments were carried out under the following conditions.

| | |
|---|---|
| Central frequency | 2,450 MHz |
| Load in the heating chamber | Food article placing table of ceramic material |
| Door Shielding member | Two kinds of perforated plates having pitches and perforation diameters as follows |
| Perforated plate (1) $P_1$ (5mm × 9mm × $\phi$3.0) | |
| Perforated plate (2) $P_2$ (0.8mm × 0.93mm × $\phi$0.7) | |

In FIGS. 12(*a*-1) to 12(*b*-3), there are shown results of the above experiments carried out for determining the microwave leakage amounts $P_L$ (mW/cm$^2$), with the distances between the perforated plate Ip and dielectric plate member (glass plate Gp) as shown in FIGS. 8 to 11 being taken as parameters at varying specific inductive capacities $\epsilon_r$ for the dielectric plate member. While these inductive capacities are those at 1 MHz, they are nevertheless useful for calculating impedance at the microwave frequencies at which the experiments were carried out. The graphs of FIGS. 12(*a*-1) to 12(*a*-3) are based on the results obtained when using the perforated plate $P_1$ (5 mm×9 mm×$\phi$3.0), and those of FIGS. 12(*b*-1) to 12(*b*-3) are derived from the results obtained when using the perforated plate $P_2$ (0.8 mm×0.93 mm×$\phi$0.7), while the numerals in the parentheses for the figure numbers, i.e., (a-1), (a-2), (a-3), (b-1), (b-2) and (b-3) denote the number of the dielectric plates (glass plates) employed.

In FIGS. 12(*a*-1) through 12(*b*-3), it is to be noted that the test results shown in FIGS. 12(*a*-1) and 12(*b*-1) were obtained based on the arrangement of FIG. 9 with the distances $l_1$ between the perforated plate Ip and dielectric member or glass plate Gp1 taken as parameters, those shown in FIGS. 12(*a*-2) and 12(*b*-2) were obtained based on the arrangement of FIG. 10 with the distances $l_2$ between the perforated plate Ip and glass plate Gp1 taken as parameters, and those shown in FIGS. 12(*a*-3) and 12(*b*-3) were obtained based on the arrangement of FIG. 11, with the distances $l_3$ between the perforated plate Ip and glass plate Gp1 being taken as parameters and with the distance between the perforated plate Ip and the outermost glass plate Gp3 being set at 30 mm.

In FIGS. 12(*a*-1), 12(*a*-2), 12(*b*-1) and 12(*b*-2), the results obtained when the tip of the probe V is spaced by the distances $l_1$ and $l_2$ from the perforated plate Ip without the provision of glass plates, are also shown in dotted lines. Moreover, in FIGS. 12(*a*-1), 12(*b*-1) and 12(*a*-3), results obtained with the use of glass plate coated with electrically conductive and light transmitting ZnO (tin oxide) film on both surfaces are also shown.

From the foregoing results of the experiments, it may be concluded as follows.

(a) Although there is slight difference in the absolute values for the amount of microwave leakage, similar variations are noticed for the perforated plates $P_1$ and $P_2$.

(b) Meanwhile, differences due to employment of different dielectric materials are also clearly noticed in the graphs of FIGS. 12(*a*-1) to 12(*b*-3). More specifically, the values shown by the dotted lines and obtained without the use of the dielectric member ($\epsilon_r = 1$) and those obtained with the use of the dielectric member of polypropylene ($\epsilon_r \approx 2 \sim 2.5$) are similar to each other, while the values obtained with the use of the heat reinforced glass ($\epsilon_r \approx 4.5 \sim 7$) are very similar to those obtained with the use of heat crystallizing glass ($\epsilon_r \approx 7 \sim 10$). Therefore, it is seen that the microwave leakage characteristics are altered by the variations of the characteristic impedance ($Z = 120\pi/\sqrt{\epsilon_r}$) only due to the difference of the specific inductive capacity.

(c) Subsequently, it was noticed that the microwave leakage was reduced when a glass plate of low impedance coated with the electrically conductive film was employed.

Still referring to FIGS. 12(*a*-1) through 12(*b*-3), an example of how to read the graphs will be described hereinbelow.

For the arrangements of the present invention which employ a heat reinforced or chemically reinforced glass plate member, attention should be directed to the lines marked with markings □ or ×, while by comprising the data denoted by the lines marked with the marking ○ with the above lines marked with the markings □ and ×, the factors defining the present invention can readily be obtained for the design of the high frequency heating apparatus.

The microwave leakage amounts in the absence of the glass plate are seen to be 0.25 mW/cm$^2$ from the lines marked with the markings ○ in the graphs of FIGS. 12(*a*-1) and 12(*a*-2) for the case where the perforated plate $P_1$ is employed, while for the case where the perforated plate $P_2$ is employed the leakage can be seen to be 0.6 mW/cm$^2$ from the same lines, said microwave leakage amounts being those for the impedance $Z_S$.

Although not shown in the graphs of FIGS. 12(*a*-1) to 12(*b*-3), it has been confirmed through the experiments that, in the arrangement of FIG. 6, i.e., in the case where two glass plates are employed, with the distance therebetween being set to be more than 10 mm, the microwave leakage level can be made smaller than that in the case where no glass plate is provided by setting the distance $l_{2a}$ (FIG. 6) no more than 5 mm. Results of experiments in the case where the distance between the glass plates is set to be no more than 5 mm are shown in FIGS. 12(*a*-2) and 12(*b*-2). By observing the line marked with the marking □ in FIG. 12(*b*-2), it is seen that the microwave leakage amount can be reduced below the microwave leakage level of 0.6 mW/cm$^2$, i.e. that for the absence of the glass plate, if the distance $l_{2b}$ (FIG. 7) between the perforated plate and the glass plate is set to be more than approximately 5 mm. The data represented by the line marked with the marking □ indicate the microwave leakage amount corresponding to the impedance $Z_T$.

FIGS. 12(*a*-3) and 12(*b*-3) show the experimental results in the case where three glass plates are employed. By way of example, by observing the line marked with the marking □ in FIG. 12(*a*-3), it can be seen that the microwave leakage amount may be reduced below the microwave leakage level of 0.25 mW/cm$^2$, i.e. that for the absence of the glass plate, if the distance $l_3$ (FIG. 5) is set to be more than 10 mm.

Meanwhile data obtained by employment of glass plates coated with ZnO (tin oxide) are shown in FIGS. 12(*a*-1) and 12(*a*-3), from which it can be seen that the microwave leakage amount therefrom is smaller than the microwave leakage level which occurs at the impedance $Z_S$.

As is clear from the foregoing description, based on the results of experiments as described above, the present inventors have found the conditions for the door arrangement in which, even if glass plates are provided, the microwave leakage amounts are reduced below the microwave leakage level in the absence of a dielectric plate member, and have thus introduced the improved door arrangement described with reference to FIGS. 5 to 7, with substantial elimination of the disadvantages inherent in the conventional arrangements of this kind.

In the foregoing experiments, a perforated plate is described as being employed for the shielding member, but similar results can be obtained, even if such perforated plate is replaced by a wire mesh or the like.

It should also be noted here that in the foregoing embodiments although the improved door arrangement directly related to the present invention is mainly described with reference to a microwave oven with a drawer type door assembly and having an electric heating capability in addition to the high frequency energy heating capability, the concept of the present invention is not limited in its application to such type of microwave ovens, but is readily be applicable to high frequency heating apparatuses in general in which reduction of high frequency energy leakage or prevention of excessive temperature rise at the front portion of the door is required.

Although the present invention has been fully described by way of example with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A high frequency heating apparatus which comprises:

(a) an oven defining structure, (b) a heating cavity defined by wall members within said oven defining structure, (c) a door assembly adapted to selectively open and close an access opening defined at one side of said heating cavity, and (d) means for supplying microwave energy into said heating cavity for dielectric heating of an object to be heated placed therein, said door assembly further comprising a door shielding member and a plurality of glass plate members disposed in front of and on the outer side of said door shielding member, said shielding member having an impedance and said plurality of glass plate members being of a material and having a thickness and being spaced from said shielding member and each other for making the composite impedance $Z_T$ of said shielding member, said glass plate members and the space outside said heating cavity equal to or smaller than the composite impedance $Z_S$ of the shielding member and the space outside the heating cavity without said glass plate member and also substantially different from the impedance of the space within said heating cavity.

2. A high frequency heating apparatus as claimed in claim 1, further including an electric heating arrangement provided in said heating cavity for electrically heating the object to be heated in said heating cavity.

3. A high frequency heating apparatus which comprises:

(a) an oven defining structure, (b) a heating cavity defined by wall members within said oven defining structure, (c) a door member adapted to selectively open and close an access opening defined at one side of said heating cavity, (d) means for supplying microwave energy into said heating cavity for dielectric heating of an object to be heated placed therein, and (e) an electric heating arrangement provided in said heating cavity for electrically heating the object to be heated in said heating cavity, said door assembly further comprising a door shielding member and a plurality of glass plate members having substantially the same thickness and being of the same material and being disposed in front of and on the outer side of said door shielding member remote from said heating cavity, said shielding member having an impedance and said pluraltiy of glass plate members being spaced from said shielding member and each other for making the composite impedance $Z_T$ of said shielding member, said glass plate members and the space outside said heating cavity equal to or smaller than the composite impedance $Z_S$ of said shielding member and the space outside said heating cavity without said glass plate member and also substantially different from the impedance of the space within said heating cavity.

4. A high frequency heating apparatus as claimed in claim 3, wherein at least one of said plurality of glass plate members has coated on the surface thereof a film material having both electrically conductive and light transmitting properties.

5. A high frequency heating apparatus as claimed in claim 3, wherein said plurality of glass plate members are an inner glass plate and an outer glass plate spaced more than 10 mm. the distance between said shielding member and said inner glass plate being no more than 5 mm.

6. A high frequency heating apparatus as claimed in claim 3, wherein said plurality of glass plate members are an inner glass plate and an outer glass plate spaced no more than 5 mm, the distance between said shielding member and said inner glass plate being more than 10 mm.

7. A high frequency heating apparatus as claimed in claim 3, wherein said plurality of glass plate members are an inner glass plate, an intermediate glass plate and an outer glass plate, the distance between said inner glass plate and intermediate glass plate being less than 7 mm and the distance between said intermediate glass plate and said outer glass plate being more than 5 mm, and the distance between said shielding member and said inner glass plate being more than 10 mm.

8. A high frequency heating apparatus as claimed in claim 3, wherein said shielding member is a metallic perforated plate.

9. A high frequency heating apparatus as claimed in claim 3, wherein said shielding member is a wire mesh.

* * * * *